US006514036B2

(12) United States Patent
Marshall et al.

(10) Patent No.: US 6,514,036 B2
(45) Date of Patent: Feb. 4, 2003

(54) RADIAL FLOW FAN WITH IMPELLER HAVING BLADE CONFIGURATION FOR NOISE REDUCTION

(75) Inventors: James D. Marshall, Mallorytown (CA); Michael A. Milligan, Gananoque (CA)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/845,061

(22) Filed: Apr. 27, 2001

(65) Prior Publication Data

US 2002/0159881 A1 Oct. 31, 2002

(51) Int. Cl.[7] ..... F04D 29/66
(52) U.S. Cl. ..... 415/98; 415/102; 415/206
(58) Field of Search ..... 415/98, 119, 206, 415/102, 101; 416/175, 203; 15/326

(56) References Cited

U.S. PATENT DOCUMENTS 3,601,876 A 8/1971 Vogt
4,187,055 A 2/1980 Barnstead
6,105,206 A 8/2000 Tokumaru et al.
6,149,381 A * 11/2000 Lee ..... 415/119
6,158,954 A * 12/2000 Nabeshima et al. ..... 415/119
6,345,951 B1 * 2/2002 Choi ..... 415/1

* cited by examiner

*Primary Examiner*—Edward K. Look
*Assistant Examiner*—Kimya N McCoy
(74) *Attorney, Agent, or Firm*—Harness, Dickey & Pierce, P.L.C.

(57) ABSTRACT

A debris blower with a radial flow fan having an impeller that includes a set of impeller blades that are spaced about a rotary axis of the impeller in a predetermined manner such that at least two spacing angles are used to space the impeller blades circumferentially apart from one another. The use of a plurality of spacing angles operates to distribute the noise that is generated by the rotating impeller blades over several tones or frequencies.

18 Claims, 3 Drawing Sheets

RADIAL FLOW FAN WITH IMPELLER HAVING BLADE CONFIGURATION FOR NOISE REDUCTION

FIELD OF THE INVENTION

The present invention generally relates to radial flow fans and more particularly to a debris blower including a radial flow fan having an impeller with a noise reducing blade configuration.

BACKGROUND OF THE INVENTION

Debris blowers are known in which an impeller or a fan driven by a motor creates an air stream which is directed into a duct. The air stream discharged from the open end of the duct is employed to blow debris off walks, driveways and lawns. Known higher performance blowers employ a radial flow fan in order to efficiently generate the pressure and volumetric flow rate required for the application. These devices tend to be relatively noisy such that their use is often unpleasant for the user and those in the vicinity of the blower.

The scale of the impeller, the practical speeds at which it can be driven, and a practical number of blades results in blade passing frequencies that create tonal noise emission. Tonal emission at the blade passing frequency typically falls within the frequency range over which the human ear is sensitive and creates an unpleasant sound quality. Further, as the impeller blades of these devices are typically spaced apart evenly around the circumference of the impeller, the noise emission contains one or more discrete tones at frequencies related to the blade passing rate. It is this concentration of noise at one or more particular frequencies, rather than the overall amplitude of the noise, that most people find unpleasant.

Given the design criteria of modern high performance debris blowers, along with issues relating to its overall size, weight and cost, changes to the size of the impeller, its rotational speed and/or the number of impeller blades to change the frequency of the noise that is generated by the passing impeller blades to a frequency that is outside the sensitive range of human hearing have not been practicable.

It is therefore an object of the present invention to provide a radial flow fan having an impeller with a blade configuration that spreads the blade passing noise out over several frequencies to improve the quality of the noise that is generated during the operation of the radial flow fan.

SUMMARY OF THE INVENTION

In one preferred form, the present invention provides a radial flow fan having a housing having at least one inlet, an outlet and an impeller cavity in fluid connection with the inlet and the outlet, and an impeller. The impeller is rotatably supported in the impeller cavity on a rotary axis and includes an annular flange member and a plurality of impeller blades that are fixedly coupled to the annular flange member such that each of the impeller blades is adjacent another of the impeller blades in a predetermined circumferential direction. Each adjacent pair of the impeller blades defines a spacing angle. The impeller is configured such that a first predetermined quantity of the impeller blades are spaced apart from an associated adjacent impeller blade with a first predetermined spacing angle and a second predetermined quantity of the impeller blades are spaced apart from an associated adjacent impeller blade with a second predetermined spacing angle that is not equal to the first predetermined spacing angle. The plurality of first impeller blades are configured to intake a compressible fluid in a first direction generally parallel the rotary axis and to expel the compressible fluid to the outlet in a direction generally tangent the impeller cavity. The use of a plurality of spacing angles operates to distribute the noise that is generated by the rotating impeller blades over several tones or frequencies.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
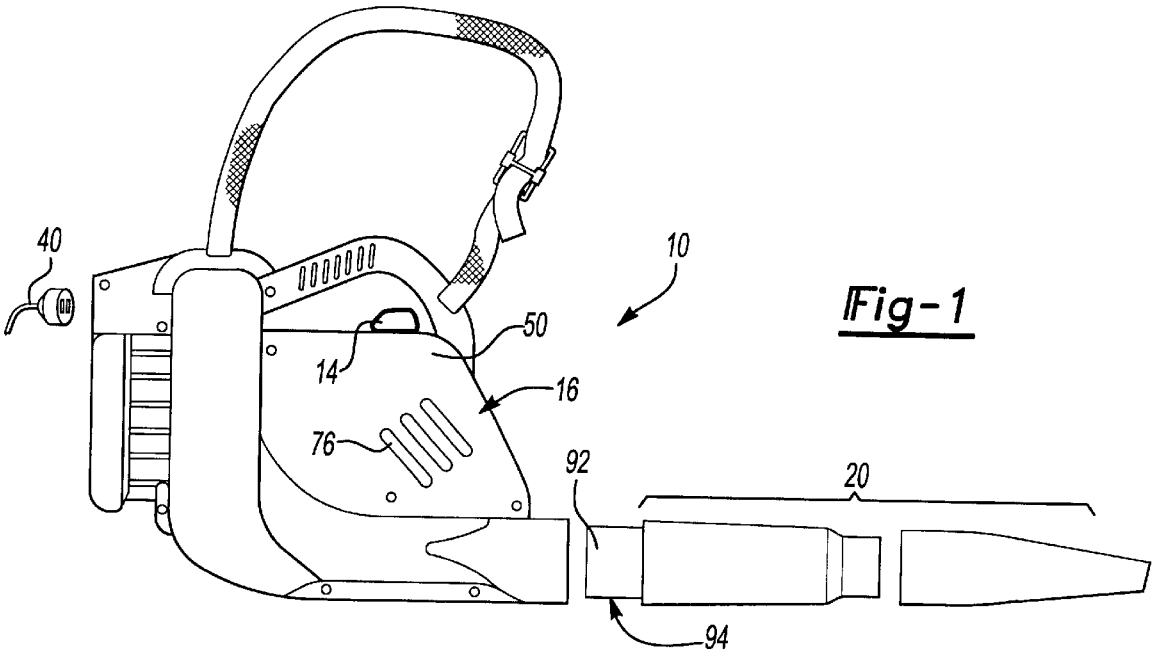
FIG. 1 is a side view of a blower constructed in accordance with the teachings of the present invention.
Figure 2:
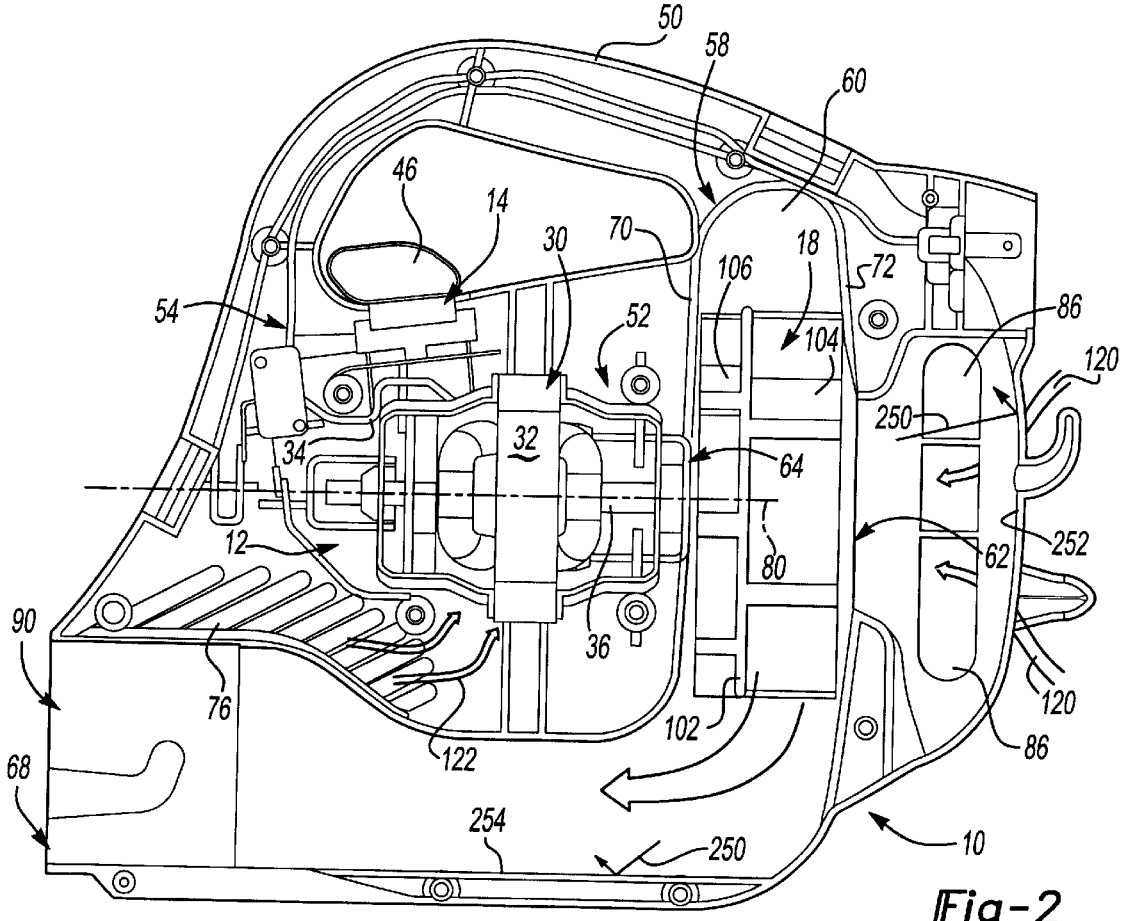
FIG. 2 is a sectional view of the blower of FIG. 1 taken along its longitudinal axis.
Figure 3:
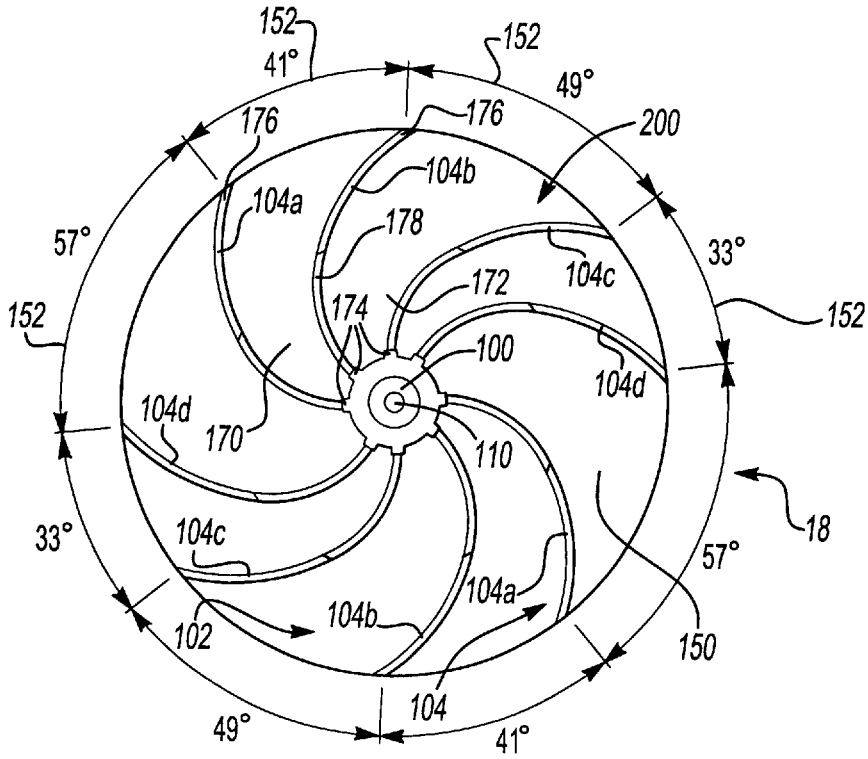
FIG. 3 is an end view of a portion of the blower of FIG. 1, illustrating the set of first impeller blades in greater detail.
Figure 4:
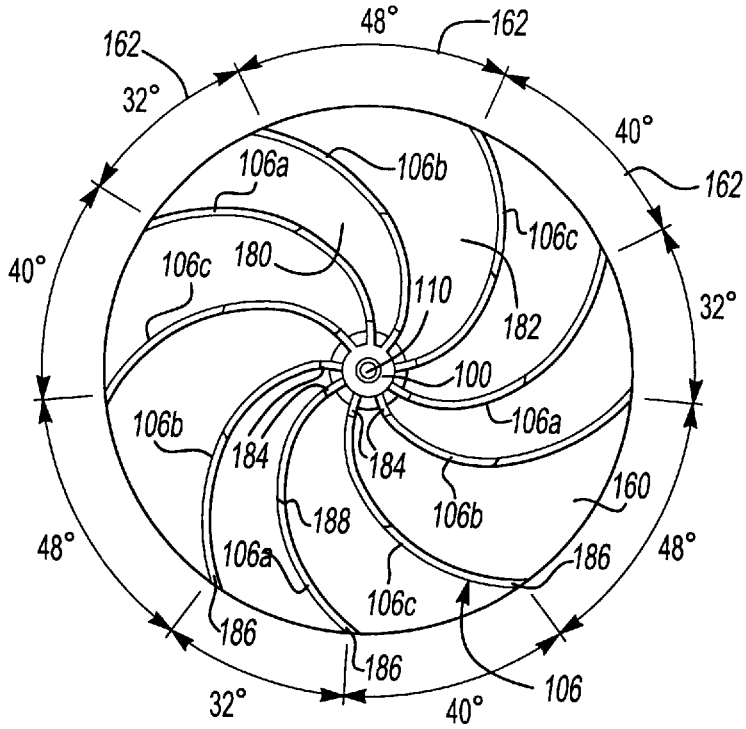
FIG. 4 is an end view of the impeller illustrating the set of second impeller blades in greater detail.
Figure 5:
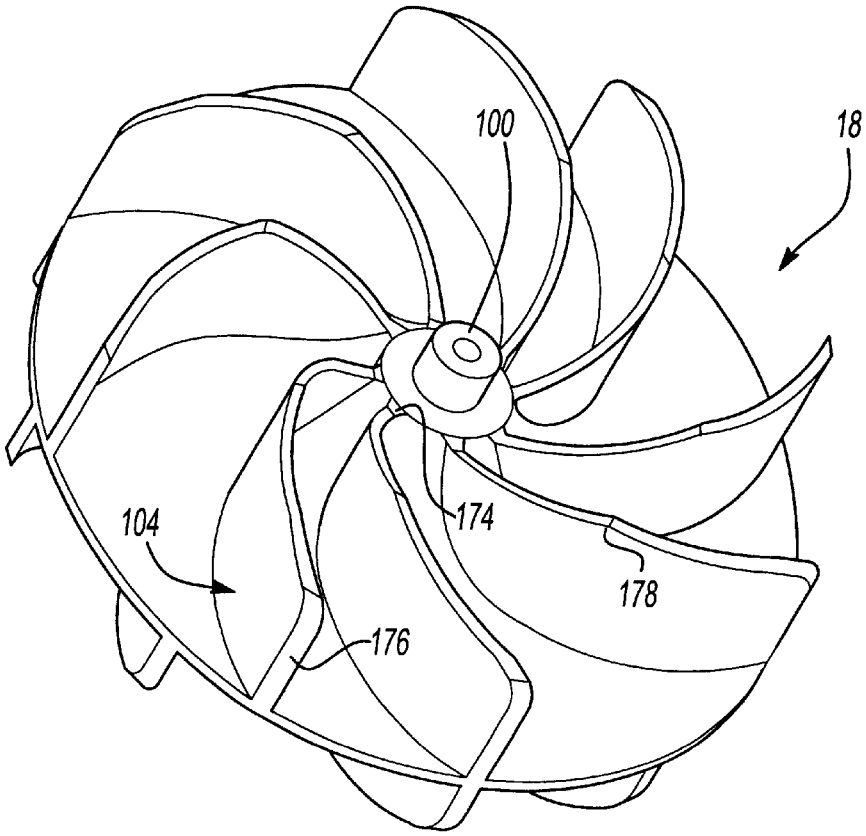
FIG. 5 is a perspective view of the impeller illustrating the set of first impeller blades.
Figure 6:
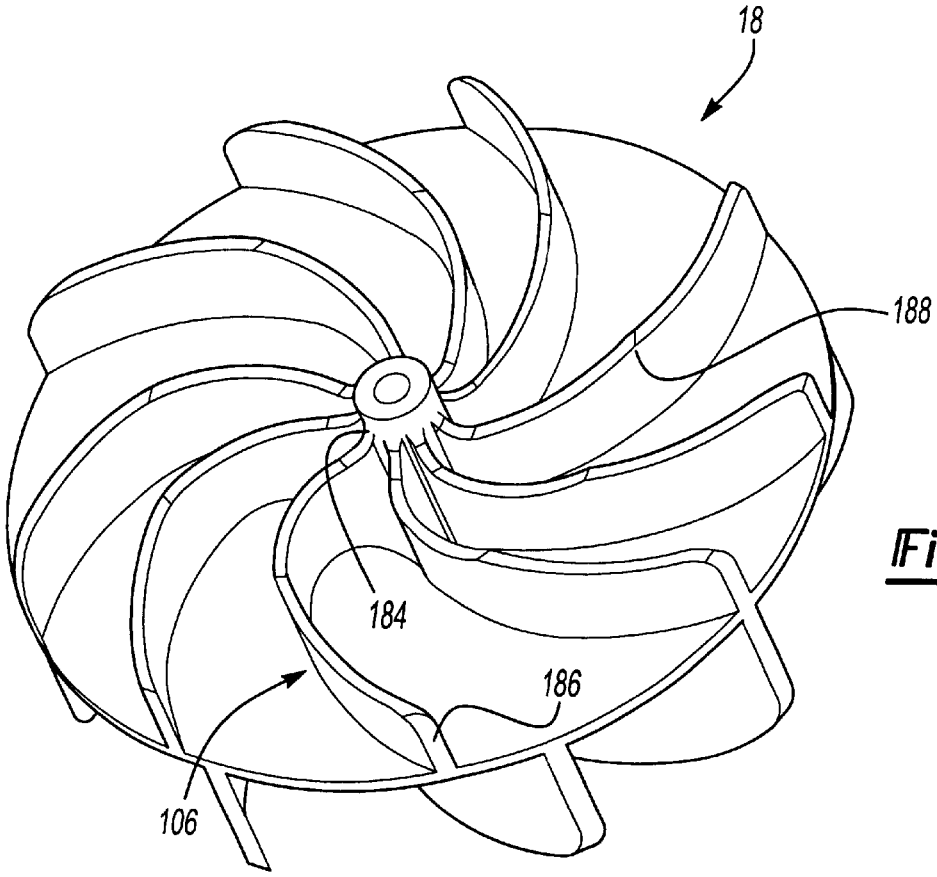
FIG. 6 is a perspective view of the impeller illustrating the set of second impeller blades.

With reference to FIGS. 1 and 2 of the drawings, a blower constructed in accordance with the teachings of the present invention is generally indicated by reference numeral 10. The blower 10 is shown to include a power source 12, a switch assembly 14 for selectively controlling the power source, a housing 16, an impeller 18 and a discharge tube assembly 20. In the particular embodiment illustrated, the power source 12 is illustrated to include a motor assembly 30 having an electric motor 32 with a pair of terminals 34 and an output shaft 36. The motor assembly 30 and switch assembly 14 are conventional in their construction and operation and need not be discussed in significant detail. Briefly, the switch assembly 14 is coupled to a source of electric power (e.g., via a power cord 40) and via the terminals 34, selectively provides the motor 32 with electricity in a predetermined manner that is related to the amount by which a trigger button 46 on the switch assembly 14 is depressed.

The housing 16 is illustrated to include a pair of housing shells 50 that collectively define a motor mounting portion 52, a switch mounting portion 54 and a volute 58 having an impeller cavity 60, a primary inlet 62, a secondary inlet 64 and an outlet 68. The motor and switch mounting portions 52 and 54 are conventional in their construction and operation, being employed to fixedly couple the motor assembly 30 and the switch assembly 14, respectively, within the housing 16. When the motor assembly 30 is coupled to the housing 16 by the motor mounting portion 52, the distal end of the output shaft 36 extends rearwardly into the impeller cavity 60.

The impeller cavity 60 extends radially around the output shaft 36 and is substantially enveloped on its forward and rearward sides by a pair of annular endwalls 70 and 72, respectively, into which the secondary and primary inlets 62 and 64, respectively, are formed. A plurality of vent apertures 76 that are skewed to the rotary axis 80 of the output shaft 36 are formed through the housing 16 forwardly of the endwall 70. A plurality of circumferentially extending inlet apertures 86 are spaced around the housing 16 rearwardly of the endwall 72. The circumference of the portion of the housing 16 into which the inlet apertures 86 are formed is illustrated to be larger than the diameter of the primary inlet 62. The outlet 68 intersects the impeller cavity 60 generally tangent to the outer diameter of the impeller cavity 60 in a manner that is conventionally known. However, the outlet 68 turns forwardly after this intersection and extends along an axis that is offset both vertically and horizontally from the rotary axis 80 of the output shaft 36. The outlet 68 terminates at a coupling portion 90 that is configured to releasably engage a mating coupling portion 92 on the proximal end 94 of the discharge tube assembly 20.

With reference to FIGS. 2 through 6, the impeller 18 is illustrated to include a mounting hub 100, a flange member 102, a set of first impeller blades 104 and a set of second impeller blades 106. The mounting hub 100 is generally cylindrical and includes a mounting aperture 110, which is sized to engage the distal end of the output shaft 36 in a press-fit manner to thereby couple the impeller 18 to the motor assembly 30 for rotation about the rotary axis 80. Those skilled in the art will readily understand that although press-fitting is employed to fix the impeller 18 for rotation with the output shaft 36, any appropriate coupling means may be utilized for this purpose. The flange member 102 is coupled to the mounting hub 100 and extends radially outwardly therefrom in a continuous manner to thereby completely segregate the sets of first and second impeller blades 104 and 106 from one another.

During the operation of the blower 10, the impeller 18 rotates within the impeller cavity 60. Rotation of the set of first impeller blades 104 imparts momentum to the air that is disposed between each adjacent pair of first impeller blades 104, slinging the air radially outwardly toward the outlet 68. The air exiting the outlet 68 as a result of the momentum imparted by the set of first impeller blades 104 creates a negative pressure differential that generates a primary air flow 120 that enters the housing 16 through the inlet apertures 86 and is directed into the set of first impeller blades 104 by the primary inlet 62 in a direction generally parallel the rotary axis 80.

Similarly, rotation of the set of second impeller blades 106 imparts momentum to the air that is disposed between each adjacent pair of second impeller blades 106, slinging the air radially outwardly toward the outlet 68. The air exiting the outlet 68 as a result of the momentum imparted by the set of second impeller blades 106 creates a negative pressure differential that generates a secondary air flow 122 that enters the housing 16 through the vent apertures 76. The housing 16 is constructed such that the motor 32 rejects heat to the secondary air flow 122 before it travels through the secondary inlet 64. The secondary inlet 64 directs the secondary flow 122 into the set of second impeller blades 106 in a direction generally parallel the rotary axis 80 and opposite the primary air flow 120.

The primary and secondary air flows 120 and 122 combine in the outlet 68 and are discharged through the coupling portion 90 into the discharge tube assembly 20. In the example provided, the height of the first impeller blades 104 is substantially larger than that of the second impeller blades 106 and as such, the mass flow rate of the primary air flow 120 will be substantially larger than the mass flow rate of the secondary air flow 122. As the flange member 102 is continuous, the primary and secondary flows 120 and 122 cannot travel in an axial direction beyond the flange member 102 until they have been slung radially outwardly of the impeller 18.

The set of first impeller blades 104 is fixedly coupled to a first side 150 of the flange member 102 such that each pair of the first impeller blades 104 (e.g., first impeller blades 104*a* and 104*b*) is separated by a predetermined spacing angle 152, wherein one of the pair of first impeller blades 104 (e.g., first impeller blade 104*b*) is spaced apart from the other one of the pair of first impeller blades 104 (e.g., first impeller blade 104*a*) in a predetermined circumferential direction by the spacing angle 152. The set of first impeller blades 104 are spaced about the flange member 102 such that spacing angles 152 having at least two different magnitudes are employed to space the first impeller blades 104 apart. Preferably, the set of first impeller blades 104 are spaced apart with a spacing angles 152 having a multiplicity of magnitudes, wherein the spacing angles 152 are distributed in a predetermined pattern that is repeated around the circumference of the impeller 18.

Similarly, the set of second impeller blades 106 is fixedly coupled to a second side 160 of the flange member 102 such that each pair of the second impeller blades 106 (e.g., second impeller blades 106*a* and 106*b*) is separated by a predetermined spacing angle 162, wherein one of the pair of second impeller blades 106 (e.g., second impeller blade 106*b*) is spaced apart from the other one of the pair of second impeller blades 106 (e.g., second impeller blade 106*a*) in a predetermined circumferential direction by the spacing angle 162. The set of second impeller blades 106 are also spaced about the flange member 102 such that spacing angles 162 having at least two different magnitudes are employed to space the second impeller blades 106 apart. As with the set of first impeller blades 104, the set of second impeller blades 106 are preferably spaced apart with spacing angles 162 having a multiplicity of magnitudes, wherein the spacing angles 162 are distributed in a predetermined pattern that is repeated around the circumference of the impeller 18. Also preferably, the magnitudes and pattern of spacing angles 162 for the set of second impeller blades 106 is different from the magnitudes and pattern of the spacing angles 152 for the set of first impeller blades 104.

In the particular embodiment illustrated, the pattern of spacing angles 152 that is employed for the set of first impeller blades 104 is configured such that a first one of the first impeller blades 104 (e.g., first impeller blade 104*b*) is adjacent a first one of the other first impeller blades (e.g., first impeller blade 104*a*) and cooperates to define a first area 170 on the flange member 102 therebetween, and each of the first impeller blades 104 (e.g., first impeller blade 104*b*) is also adjacent a second one of the other first impeller blades (e.g., first impeller blade 104*c*) and cooperates to define a second area 172 on the flange member 102 therebetween. The spacing of the first impeller blades 104 is such that none of the first and second areas 170 and 172 that are adjacent any one of the first impeller blades 104 is equal in magnitude.

Each of the first impeller blades 104 is shown to begin at an inward point 174 and terminate at an outward point 176. Each of the first impeller blades 104 (e.g., first impeller blade 104*b*) is configured such that its inward point 174 is radially inward of the outward point 176 of the first one of the other first impeller blades 104 (e.g., first impeller blade 104*a*) and its outward point 176 is radially outward of the inward point 174 of the second one of the other first impeller blades 104 (e.g., first impeller blade 104*c*). Accordingly, a first straight line passes through the mounting aperture 110 through the inward point 174 of the first impeller blade 104*b* and the outward point 176 of the first impeller blade 104*a* and a second straight line passes through the mounting aperture 110 through the inward point 174 of the first impeller blade 104*c* and the outward point 176 of the first impeller blade 104*b*. Each first impeller blade 104 is arcuately shaped from its inward point 174 to its outward point 176. Each first impeller blade 104 tapers outwardly away from the flange member 102 from its inward point 174 to an intermediate point 178 between the inward and outward points 174 and 176.

Similarly, the pattern of spacing angles 162 that is employed for the set of second impeller blades 106 is configured such that each of the second impeller blades 106 (e.g., second impeller blade 106*b*) is adjacent a first one of the other second impeller blades (e.g., second impeller blade 106*a*) and cooperates to define a third area 180 on the flange member 102 therebetween, and each of the second impeller blades 106 (e.g., second impeller blade 106*b*) is also adjacent a second one of the other second impeller blades (e.g., second impeller blade 106*c*) and cooperates to define a fourth area 182 on the flange member 102 therebetween. The spacing of the second impeller blades 106 is such that none of the third and fourth areas 180 and 182 that are adjacent any one of the second impeller blades 106 is equal in magnitude.

Each of the second impeller blades 106 begins at an inward point 184 and terminates at an outward point 186. Each of the second impeller blades 106 (e.g., second impeller blade 106*b*) is configured such that its outward point 186 is radially outward of the inward point 184 of the first one of the other second impeller blades 106 (e.g., second impeller blade 106*a*) and its inward point 184 is radially inward of the outward point 186 of the second one of the other second impeller blades 106 (e.g., second impeller blade 106*c*). Each second impeller blade 106 is arcuately shaped from its inward point 184 to its outward point 186. Accordingly, a first straight line passes through the mounting aperture 110 through the inward point 184 of the first impeller blade 106*b* and the outward point 186 of the first impeller blade 106*c* and a second straight line passes through the mounting aperture 110 through the inward point 184 of the first impeller blade 106*a* and the outward point 186 of the first impeller blade 106*b*. Each second impeller blade 106 tapers outwardly away from the flange member 102 from its inward point 184 to an intermediate point 188 between the inward and outward points 184 and 186.

Preferably, the spacing between any adjacent pair of impeller blades is not equal to any other spacing between an adjacent pair of any of the other first and second impeller blades 104 and 106 to thereby distribute the noise energy over a maximum number of frequencies. Construction in this manner, however, is extremely difficult, particularly where the impeller 18 is formed in a molding process, due to the unsymmetrical distribution of material in the impeller 18. The unsymmetrical distribution of material tends to facilitate distortion in the molded impeller 18 as it cools, as well as offsets its rotational center of gravity about its axis of rotation so that it vibrates when it is rotated.

In view of these difficulties, the set of first impeller blades 104 are instead divided into a plurality of identically configured first blade groups 200, wherein each of the first blade groups 200 includes an identical quantity of the first impeller blades 104 which are spaced apart in a predetermined first blade spacing pattern. In the example provided, each of the first blade groups 200 includes a total of four (4) of the first impeller blades 104*a*, 104*b*, 104*c* and 104*d*, with the first impeller blade 104*a* being spaced apart from predetermined reference point (e.g. the first impeller blade 104*d* in another first blade group 200) by an angle of 57°, the first impeller blades 104*a* and 104*b* being spaced apart with a spacing angle 152 of 41°, the first impeller blades 104*b* and 104*c* being spaced apart with a spacing angle 152 of 49° and the first impeller blades 104*c* and 104*d* being spaced apart with a spacing angle 152 of 33°. The first blade groups 200 are fixed to the first side 150 of the flange member 102 such that they are offset from one another by a predetermined angular spacing (e.g., 57°).

Similarly, the set of second impeller blades 106 are divided into a plurality of identically configured second blade groups 220, wherein each of the second blade groups 220 includes an identical quantity of the second impeller blades 106 which are spaced apart in a predetermined second blade spacing pattern. In the example provided, each of the second blade groups 220 includes a total of three (3) of the second impeller blades 106*a*, 106*b* and 106*c*, with the second impeller blade 106*a* being spaced apart from predetermined reference point (e.g. the second impeller blade 106*c* in another second blade group 220) by an angle of 40°, the second impeller blades 106*a* and 106*b* being spaced apart with a spacing angle 162 of 32° and the second impeller blades 106*b* and 106*c* being spaced apart with a spacing angle 162 of 48°. The second blade groups 220 are fixed to the second side 170 of the flange member 102 such that they are offset from one another by a predetermined angular spacing (e.g., 40°).

While noise attenuation is primarily achieved through the configuration of the impeller 18, the geometry of the housing 16 is also employed to aid in the attenuation of the noise that is generated during the operation of the blower 10. In this regard, noise that results from the rotation of the impeller 18 is not discharged in a direct or straight-line manner from the housing 16 but rather is reflected off several various interior surfaces within the housing 16 as shown in FIG. 2. For example, noise 250 that is directed rearwardly from the impeller 18 is reflected off the rearward wall 252 before it is reflected outwardly through the inlet apertures 86. Similarly, noise 250 that is directed forwardly from the impeller 18 is reflected off the walls 254 of the outlet 68 before it is discharged through the outlet 68. The reflecting of noise 250 off the various interior surfaces of the housing 16 permits the housing 16 to absorb some of the energy of the noise 250 to thereby attenuate the level of noise 250 that is transmitted out of the housing 16.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A radial flow fan comprising:

a housing having at least one inlet, an outlet and an impeller cavity in fluid connection with the inlet and the outlet; and an impeller rotatably supported in the impeller cavity on a rotary axis, the impeller having an annular flange member and a plurality of impeller blades fixedly coupled to the annular flange member such that each of the impeller blades is adjacent another of the impeller blades in a predetermined circumferential direction, each adjacent pair of impeller blades defining a spacing angle, the impeller being configured such that a first predetermined quantity of the impeller blades are spaced apart from an associated adjacent impeller blade with a first predetermined angle and a second predetermined quantity of the impeller blades are spaced apart from an associated adjacent impeller blade with a second predetermined angle that is not equal to the first predetermined angle, the plurality of impeller blades being segregated into a plurality of identically configured first blade groups, each of the first blade groups having an equal number of impeller blades, the impeller blades within one of the first blade groups being spaced apart from one another with a predetermined pattern of spacing angles including at least one of the first predetermined angle and the second predetermined angle;

wherein the plurality of impeller blades are configured to intake a compressible fluid in a first direction generally parallel the rotary axis and expel the compressible fluid to the outlet in a direction generally tangent the impeller cavity.

2. The portable debris blower of claim 1, wherein a spacing angle between a last impeller blades in a first one of the impeller blade groups and a first one of the impeller blades in a next one of the impeller blade groups is not equal to a spacing angle between each adjacent pair of impeller blades in the first one of the impeller blade groups.

3. The portable debris blower of claim 2, wherein the predetermined pattern of spacing angles includes a plurality of non-equal spacing angles.

4. The radial flow fan of claim 1, wherein the predetermined pattern of spacing angles includes a plurality of non-equal spacing angles.

5. The radial flow fan of claim 1, further comprising a plurality of second impeller blades, the second impeller blades being fixedly coupled to the annular flange member such that each of the second impeller blades is adjacent another of the second impeller blades in a predetermined circumferential direction, each adjacent pair of second impeller blades defining a second spacing angle, the impeller being configured such that a first predetermined quantity of the second impeller blades are spaced apart from an associated adjacent second impeller blade with a third predetermined angle and a second predetermined quantity of the second impeller blades are spaced apart from an associated adjacent second impeller blade with a fourth predetermined angle that is not equal to the third predetermined angle;

wherein the plurality of second impeller blades are configured to intake a compressible fluid in a second direction generally parallel the rotary axis and expel the compressible fluid to the outlet in a direction generally tangent the impeller cavity.

6. The radial flow fan of claim 5, wherein the plurality of second impeller blades are segregated into a plurality of identically configured second blade groups, each of the second blade groups having an equal number of the second impeller blades, the second impeller blades within one of the second blade groups being spaced apart from one another with a predetermined second pattern of spacing angles including at least one of the third predetermined angle and the fourth predetermined angle.

7. The portable debris blower of claim 6, wherein a spacing angle between a last impeller blades in a first one of the second impeller blade groups and a first one of the impeller blades in a next one of the second impeller blade groups is not equal to a spacing angle between each adjacent pair of the second impeller blades in the first one of the second impeller blade groups.

8. The portable debris blower of claim 7, wherein the predetermined pattern of spacing angles includes a plurality of non-equal spacing angles.

9. The portable debris blower of claim 6, wherein the predetermined pattern of spacing angles includes a plurality of non-equal spacing angles.

10. The portable debris blower of claim 6, wherein each of the second impeller blades begins at an inward point and terminates at an outward point, each of the second impeller blades being configured such that its inward point is radially inward of the outward point of the first one of the outer second impeller blades and its outward point is radially outward of the inward point of the second one of the other second impeller blades.

11. The portable debris blower of claim 10, wherein each of the second impeller blades is arcuately shaped from the inward point to the outward point.

12. The portable debris blower of claim 10, wherein each of the second impeller blades tapers outwardly away from the flange member from the inward point to an intermediate point between the inward and outward points.

13. The portable debris blower of claim 6, wherein the predetermined number of first blade groups is not, equal to the predetermined number of second blade groups.

14. The portable debris blower of claim 13, wherein a quantity of the first impeller blades that form one of the first blade groups is not equal to a quantity of the second impeller blades that form one of the second blade groups.

15. The portable debris blower of claim 1, wherein each of the impeller blades begins at an inward point and terminates at an outward point, each of the impeller blades being configured such that its inward point is radially inward of the outward point of the first one of the other impeller blades and its outward point is radially outward of the inward point of the second one of the other impeller blades.

16. The portable debris blower of claim 15, wherein each of the impeller blades is arcuately shaped from the inward point to the outward point.

17. The portable debris blower of claim 15, wherein each of the impeller blades tapers outwardly away from the flange member from the inward point to an intermediate point between the inward and outward points.

18. A radial flow fan comprising:

a housing having at least one inlet, an outlet and an impeller cavity in fluid connection with the inlet and the outlet; and an impeller rotatably supported in the impeller cavity on a rotary axis, the impeller including:

an annular flange member;

a plurality of first impeller blades fixedly coupled to the annular flange member such that each of the first impeller blades is adjacent another of the first impeller blades in a predetermined circumferential direction, each adjacent pair of first impeller blades defining a first spacing angle, the impeller being configured such that a first predetermined quantity of the first impeller blades are spaced apart from an associated adjacent first impeller blade with a first predetermined angle and a second predetermined quantity of the first impeller blades are spaced apart from an associated adjacent first impeller blade with a second predetermined angle that is not equal to the first predetermined angle, the plurality of first impeller blades being segregated into a plurality of identically configured first blade groups, each of the first blade groups having an equal number of first impeller blades, the first impeller blades within one of the first blade groups being spaced apart from one another with a predetermined pattern of spacing angles including at least one of the first predetermined angle and the second predetermined angle;

a plurality of second impeller blades, the second impeller blades being fixedly coupled to the annular flange member such that each of the second impeller blades is adjacent another of the second impeller blades in a predetermined circumferential direction, each adjacent pair of second impeller blades defining a second spacing angle, the impeller being configured such that a first predetermined quantity of the second impeller blades are spaced apart from an associated adjacent second impeller blade with a third predetermined angle and a second predetermined quantity of the second impeller blades are spaced apart from an associated adjacent second impeller blade with a fourth predetermined angle that is not equal to the third predetermined angle, the plurality of second impeller blades being segregated into a plurality of identically configured second blade groups, each of the second blade groups having an equal number of the second impeller blades, the second impeller blades within one of the second blade groups being spaced apart from one another with a predetermined second pattern of spacing angles including at least one of the third predetermined angle and the fourth predetermined angle;

wherein the plurality of first impeller blades are configured to intake a compressible fluid in a first direction generally parallel the rotary axis and expel the compressible fluid to the outlet in a direction generally tangent the impeller cavity; and wherein the plurality of second impeller blades are configured to intake a compressible fluid in a second direction generally parallel the rotary axis and expel the compressible fluid to the outlet in a direction generally tangent the impeller cavity.

* * * * *

UNITED STATES PATENT AND TRADEMARK OFFICE

CERTIFICATE OF CORRECTION

PATENT NO. : 6,514,036 B2 
DATED : February 4, 2003
INVENTOR(S) : James D. Marshall et al.

It is certified that error appears in the above-identified patent and that said Letters Patent is hereby corrected as shown below:

Column 8,
Line 25, "outer" should be -- other --
Line 37, delete ","

Signed and Sealed this

Nineteenth Day of August, 2003

JAMES E. ROGAN
*Director of the United States Patent and Trademark Office*